US005243738A

United States Patent [19]

Kiefer

[11] Patent Number: 5,243,738

[45] Date of Patent: Sep. 14, 1993

[54] ADJUSTABLE TENSION HINGE

[75] Inventor: James Kiefer, Grand Rapids, Mich.

[73] Assignee: RAN Enterprises, Inc., Grand Rapids, Mich.

[21] Appl. No.: 864,398

[22] Filed: Apr. 6, 1992

[51] Int. Cl.[5] ..... E05F 1/08

[52] U.S. Cl. ..... 16/298; 16/300; 4/241

[58] Field of Search ..... 4/240, 241; 16/298, 16/299, 300

[56] References Cited

U.S. PATENT DOCUMENTS

| | | | |
|---|---|---|---|
| 631,797 | 8/1899 | Krause | 16/300 |
| 1,013,948 | 1/1912 | Northall | 16/300 |
| 2,626,421 | 1/1953 | Lyons | 16/300 |
| 2,703,430 | 3/1955 | Thomas et al. | 16/298 |
| 2,894,277 | 7/1959 | Bogater et al. | 16/298 |

OTHER PUBLICATIONS

Photographs of a 1990 Chevrolet Lumina automobile hinge, the hinge having a torsion rod-type counterbalance spring that is adjustable.

Photographs labelled Exhibits E-H illustrate a hinge with an adjustable bias spring utilized in the trunk of some late 1980 and early 1990 Cadillac automobiles made by General Motors Corp.

Photographs of a 1984 Cadillac Fleetwood automobile hinge, the hinge having a torsion rod-type counterbalance spring that is adjustable.

Photographs of a 1992 Cadillac automobile hinge, the hinge having a coil spring adjustably retained to counterbalance the trunk lid.

*Primary Examiner*—W. Donald Bray

*Attorney, Agent, or Firm*—Price, Heneveld, Cooper, DeWitt & Litton

[57] ABSTRACT

A hinge for a vehicle deck lid includes a housing, a pivot pin mounted therein, a hinge arm mounted on the pivot pin, a lift spring to bias the hinge arm toward an open position and thereby counterbalance the weight of the deck lid, and an adjustment mechanism for adjusting the tension in the lift spring. The adjustment mechanism includes a ratchet mechanism made up of pawls on the pivot pin and catches on the housing that allows one-way rotation of the pivot pin to more tightly wind the lift spring. The ratchet mechanism further includes a bias spring that biases the pawls and catches into engagement, the bias spring having a tension that can be overcome to release the ratchet mechanism and release the tension in the lift spring.

23 Claims, 4 Drawing Sheets

ADJUSTABLE TENSION HINGE

BACKGROUND OF THE INVENTION

The present invention relates to hinges, and in particular to a hinge with an adjustable counterbalance spring for use on vehicles.

Manufacturers often utilize a spring assist to counterbalance the weight of a hinged vehicle body panel where the body panel is intended to be lifted by an operator, such as in the case of a vehicle trunk lid or deck lid. However, the panels used on different vehicles vary in weight, thus requiring that either an inventory of different hinge/spring subassemblies with different counterbalance forces be used or that a particular hinge/spring subassembly work on all vehicles. In the first case, manufacturers are becoming increasingly concerned over the proliferation of parts and the resulting increases in inventory carrying costs, assembly line space problems, and quality problems due to mis-builds. Thus, there is strong resistance toward merely adding parts to cover the need for different hinge/spring assemblies. In the second case, it is difficult to design one hinge/spring subassembly that satisfactorily works on all vehicles. This is due to the varying weight of deck lids which vary not only between car-lines, but also within a given car-line depending upon vehicle options and normal part weight variation.

One potential solution is to provide a hinge with an adjustable counterbalance force. At least one manufacturer has done so, utilizing a system of torsion rods that are adjustable in tension. However, this arrangement is somewhat bulky, and requires more installation labor than is desirable. Further, improvements are desired in cost and weight.

At least one manufacturer has chosen to build hinge/-spring subassemblies with a spiral coil spring preassembled to the hinge. This provides a compact subassembly that can be attached to the deck lid and vehicle without the need for subsequent installation of a counterbalance spring assist. However, while this arrangement is compact, the counterbalance force of the hinge assembly is not adjustable.

Where possible, it is desirable to subassemble the counterbalance spring to the hinge before the assembly to the vehicle, thus eliminating the need for a separate installation of the counterbalance spring to the vehicle. However, such a hinge if adjustable must be adjustable quickly, safely, on-line, and with a minimum of manpower and effort. This is difficult given the typical attachment position of the deck lid hinge which is located under the rear window and rear shelf of the partially assembled vehicle.

Therefore, a new or improved adjustable tension hinge is desired.

SUMMARY OF THE INVENTION

A hinge for assembly to a vehicle panel embodying the present invention includes a housing, a pivot pin mounted in the housing, a hinge arm pivotally mounted to the pivot pin, a lift spring means biasing the hinge arm rotationally toward an open position, and an adjustment means. The adjustment means allows adjustment of the tension of the lift spring means and, in one form, includes a ratchet mechanism permitting an operator to manually adjust and automatically hold a desired tension, and further includes a release means for releasing the ratchet mechanism permitting the operator to reduce the tension in the lift spring means.

In the preferred embodiment, the ratchet mechanism includes a flange on one end of the pivot pin which includes a pawl, and the housing includes a corresponding catch. The pawl and catch are biased into engagement by a lateral bias means so that the ratchet mechanism ratchets the lift spring means into successively increasing tensions as the pivot pin is rotated. The pivot pin is axially movable against a laterally biasing force so as to release the pawl and catch arrangement, and in turn release the tension in the lift spring means. Thus, the hinge provides an adjustable counterbalancing force for biasing a panel on a vehicle toward an open position.

In another form, the hinge embodying the present invention includes a housing, a hinge arm pivotally mounted therein and including means for attaching a panel thereto, a coil lift spring for biasing the hinge arm toward an open position, and an adjustment means for manually adjusting the tension of the coil lift spring.

The present invention offers several advantages over presently known structures. Initially, the present invention provides a hinge with adjustable counterbalance lift spring so that a single style hinge can be used on vehicles having different weight body panels requiring different levels of lift assist. Further, the adjustment mechanism is preassembled to the hinge so that separate assembly to the vehicle is not required. Still further, the counterbalance force is readily adjustable by introduction of a tool into the end of the pivot pin and rotation thereof. The procedure for adjustment allows a single operator to quickly adjust the tension up to a desired amount, and, if the tension is overly adjusted, to reduce the tension and start over. The design offers safety of use and ability to adjust spring tension in a simplified assembly. Further, the hinge is made of a minimum of parts so that subassembly of the hinge is simplified and costs are minimized. Still further, the hinge is compact, and requires a minimum amount of room both on the assembly line and in the vehicle. Additionally, the hinge has a low weight.

These and other features, advantages, and objects of the present invention will be further understood and appreciated by those skilled in the art by reference to the following specification, claims, and appended drawings as interpreted by the Doctrine of Equivalents.

DETAILED DESCRIPTION OF THE PREFERRED EMBODIMENT

Figure 1:
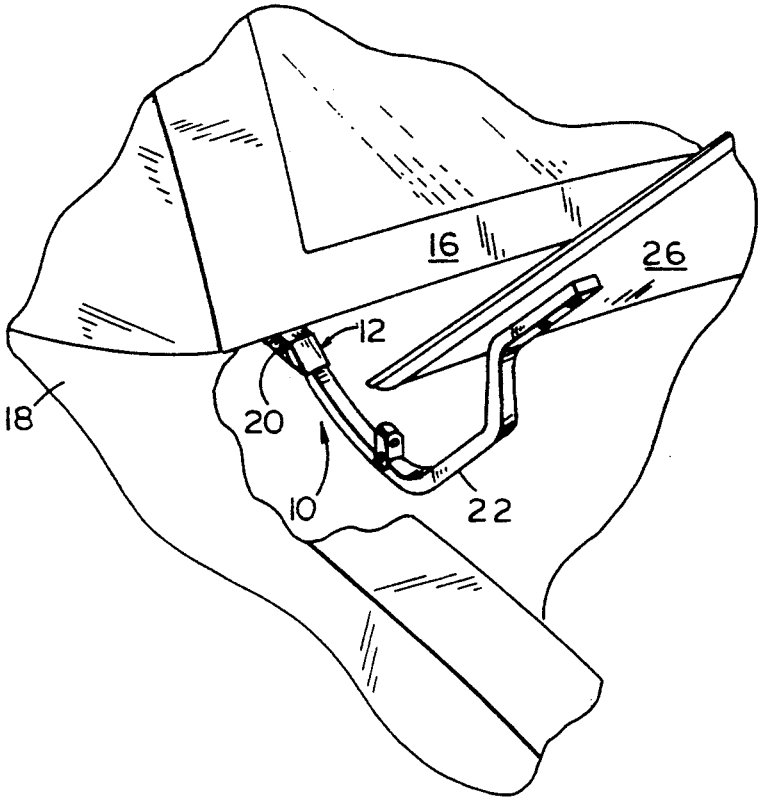
FIG. 1 is a perspective view of the hinge embodying the present invention as assembled in a vehicle.

A hinge embodying the present invention is generally referred to as numeral 10 and is illustrated in FIG. 1. Hinge 10 includes a housing 12 that attaches to the rear shelf area 16 of a vehicle 18, a pivot pin 20 that rotatably mounts in housing 12, and a hinge arm 22 that rotatably mounts to pivot pin 20. A spiral lift spring 24 mounts within housing 12 securely on pivot pin 20 and engages hinge arm 22 so as to bias hinge arm 22 toward an open position. Hinge 10 is optimally used to counterbalance the weight of a panel 26 attached hinge arm 22, so that panel 26 is more easily opened by an operator. Hinge 10 includes an adjustment mechanism that allows ready adjustment of the tension in the lift spring 24, thus allowing adjustment of the counterbalance force of lift spring 24. Thus, a single style lift spring can be used to satisfactorily counterbalance the weight on a variety of different trunk lid panels 26, each having different weights. Still further, hinge 10 allows adjustment of the tension by a single operator during installation on the assembly line. The tension mechanism allows automatic ratchet-like increasing adjustment of the tension and also allows movement of pivot pin 20 to a release position wherein the counterbalancing force generated by the tension of lift spring 24 can be released.

Figure 2:
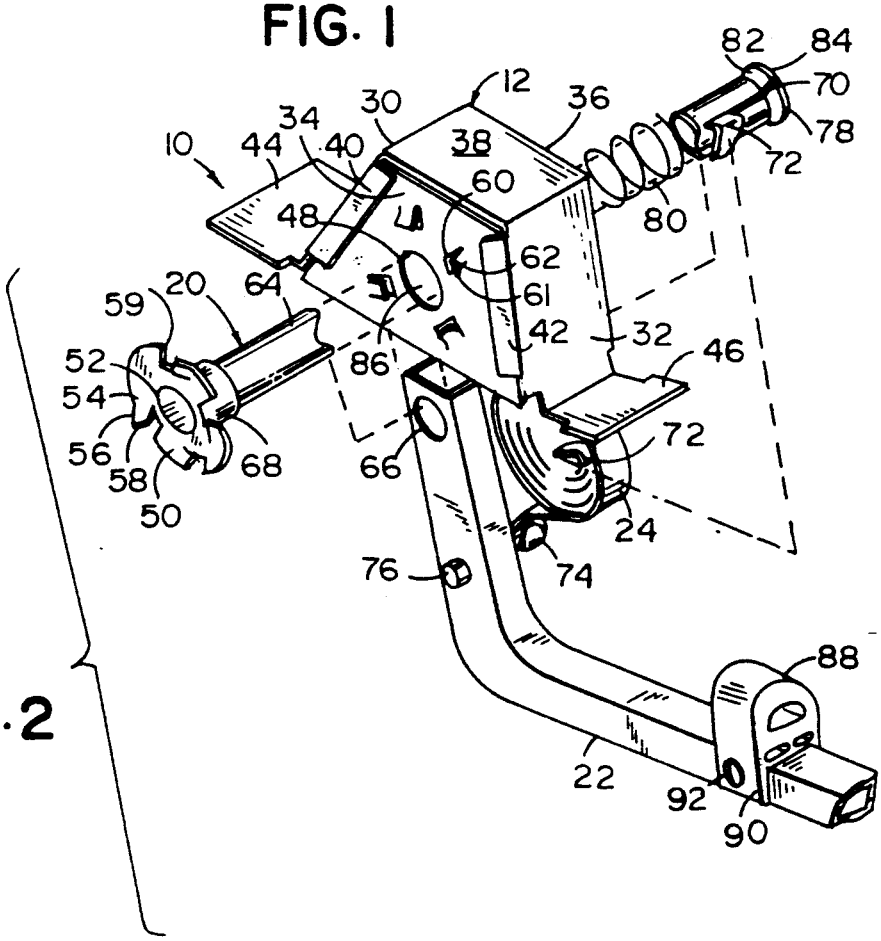
FIG. 2 is an exploded perspective view of the hinge of FIG. 1.
Figure 3:
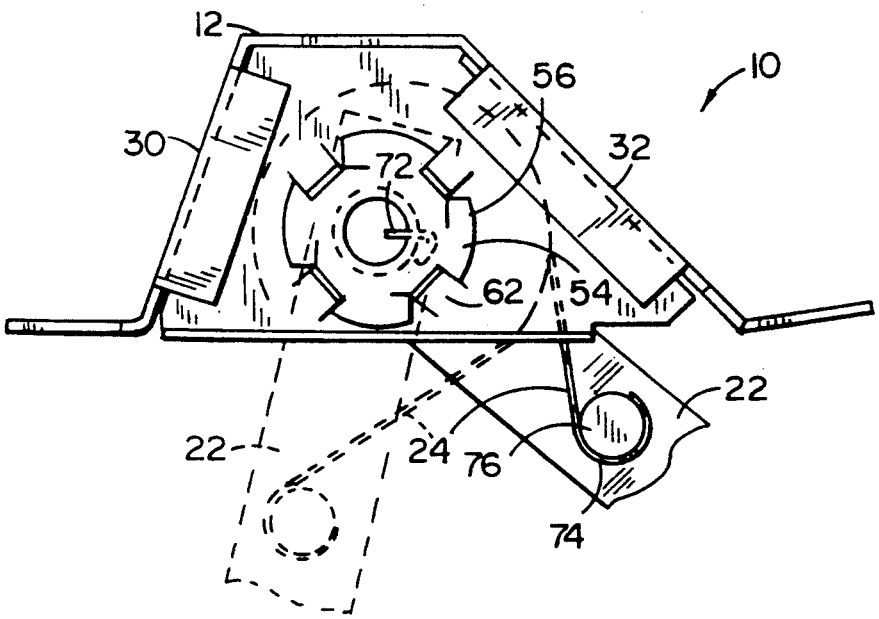
FIG. 3 is a side view of the hinge.

Housing 12 (FIGS. 2 and 3) is a downwardly open box-like structure stamped from sheet metal having a front wall 30, a rear wall 32, first and second side walls 34 and 36, and upper wall 38. Front and rear walls 30 and 32 include attachment tabs 40 and 42 for attaching to first and second side walls 34 and 36, respectively, and also include vehicle attachment tabs 44 and 46 that laterally extend therefrom and attach to vehicle 18.

Pivot pin 20 (FIG. 2) extends horizontally through holes 48 in side walls 34 and 36 and is rotationally and axially movable therein. Pivot pin 20 includes a first end 50 with a radially extending flange 52, flange 52 abutting the outside of side wall 34 limiting the lateral movement thereof toward housing 12. Flange 52 has multiple tab-like pawls 54 equally spaced around its radial perimeter that are bent to extend axially outwardly away from side wall 34. Four such pawls 54 are shown, though any number can be positioned on flange 52. Each of pawls 54 include an axially ramped portion 56 with a tooth-like front edge 58. Each of pawls 54 also include an abutting surface 59 located at the rear end thereof.

Figure 6:
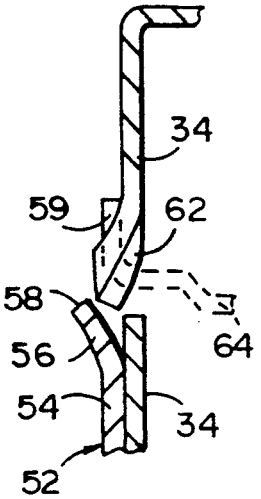
FIG. 6 is an enlarged schematic top view of the ramped portion of a single pawl relative to a respective catch.

Side wall 34 (FIG. 2) includes catches 62 that are essentially tabs bent outwardly axially in the direction of flange 52. As is best seen in FIGS. 5–8, catches 62 each include a first edge or stop 60 and a second edge 61. Catches 62 are equal in number to pawls 54 and correspond in location so that stops 60 of catches 62 engage abutting surface 59 of pawls 54 as spiral spring 24 biases pivot pin 20 in a clockwise direction in housing 12. This prevents the undesired rotation of pivot pin 20 relative to housing 12. However, as can be seen in FIG. 6 and explained below, ramped portion 56 causes pawls 54 to ramp up and over second edge 61 of catches 62 as pivot pin 20 is rotated in the counterclockwise direction.

Figure 4:
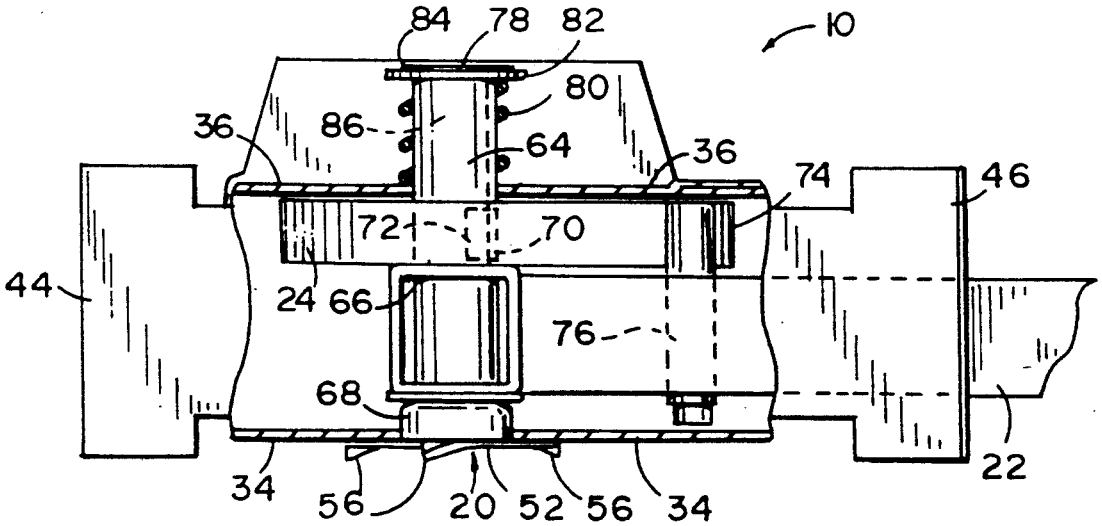
FIG. 4 is a top view of the hinge with the housing partially broken away.

Pivot pin 20 (FIGS. 2 and 4) includes a shaft 64 sized to receive and support hinge arm 22 through hole 66 in hinge arm 22. Shaft 64 includes an enlargement 68 near flange 52 that abuttingly spaces hinge arm 22 a desired distance from flange 52 and side wall 34. Shaft 64 also includes a slot 70 extending from the second end 78 of shaft 64 inwardly a sufficient distance to receive flattened inner end 72 of spiral lift spring 24 and position same adjacent hinge arm 22. Spiral lift spring 24 (FIG. 2) is a coiled spring with flattened inner end 72 shaped to slideably engage slot 70, and a curled outer end 74 shaped to grippingly engage a laterally extending anchor pin 76 extending sideways from hinge arm 22. Lift spring 24 can be a variety of different strengths as needed to lift panel 26, panels 26 having weights ranging anywhere from 20 to 80 pounds.

Figure 5:
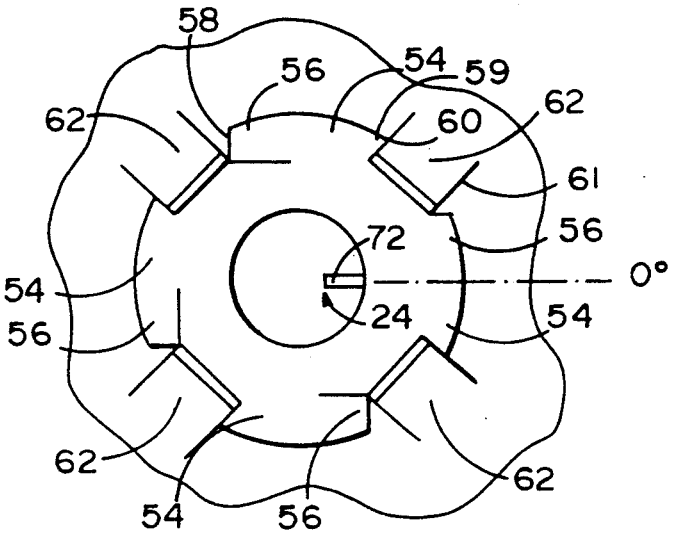
FIG. 5 is an enlarged partial side view of the hinge with the pawls and catches engaged.
Figure 8:
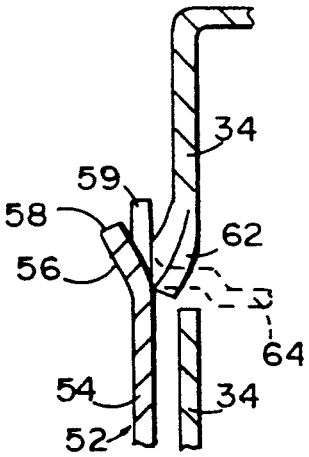
FIG. 8 is an enlarged schematic top view of the ramped portion of a single pawl relative to a respective catch with the pivot pin rotated 45°.
Figure 7:
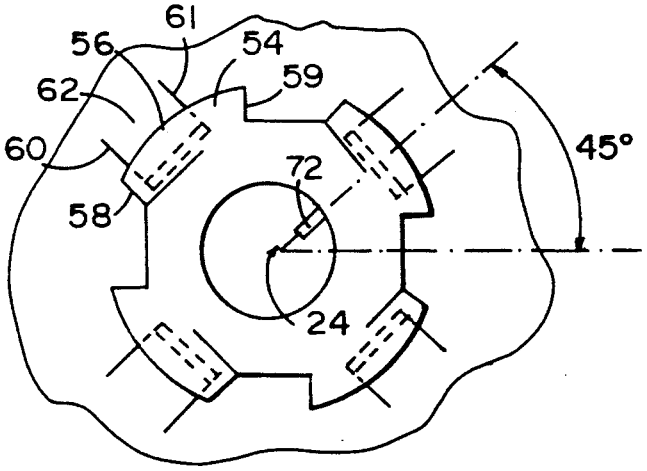
FIG. 7 is an enlarged partial side view of the hinge with the pivot pin rotated 45°.

The process of adjustably tightening spiral spring 24 is best shown in FIGS. 5–8. In FIGS. 5–6, pivot pin 20 is shown in a rest position with abutting surface 59 of pawl 54 resting against stop 60 of catch 62. As pivot pin 20 is forced to rotate counterclockwise against the bias of spiral spring 24 (FIGS. 7–8), ramped portions 56 of pawl 54 cause pawls 54 to ramp up and over catches 62 into successively tighter positions. This causes the tension in lift spring 26 to be increased. Alternatively, if pivot pin 20 is released and as a result is biased in a clockwise direction by spiral spring 24, pawls 54 tend to re-engage catches 62 since flange 52 is held tightly against side wall 34 by laterally biasing coil spring 80.

Second end 78 (FIG. 4) of pivot pin 20 extends a distance through and beyond second side wall 36. A laterally biasing coil spring 80 is received over end 78 along with a washer 82. The extreme end of 78 is then expanded, reamed or clinched so as to form a lip 84 that retains laterally biasing coil spring 80 and washer 82 thereon. Coil spring 80 laterally axially biases pivot pin 20 to a home position in a direction so that stops 60 on pawl 54 and catches 62 on side wall 34 naturally engage. However, the engagement can be overcome and pivot pin 20 made to rotate in the second direction by forcing pivot pin 20 axially laterally against the force of coil spring 80 so that flange 52 is moved away from side 34 and pawls 54 on flange 52 disengage from catches 62 on side 34.

Figure 9:
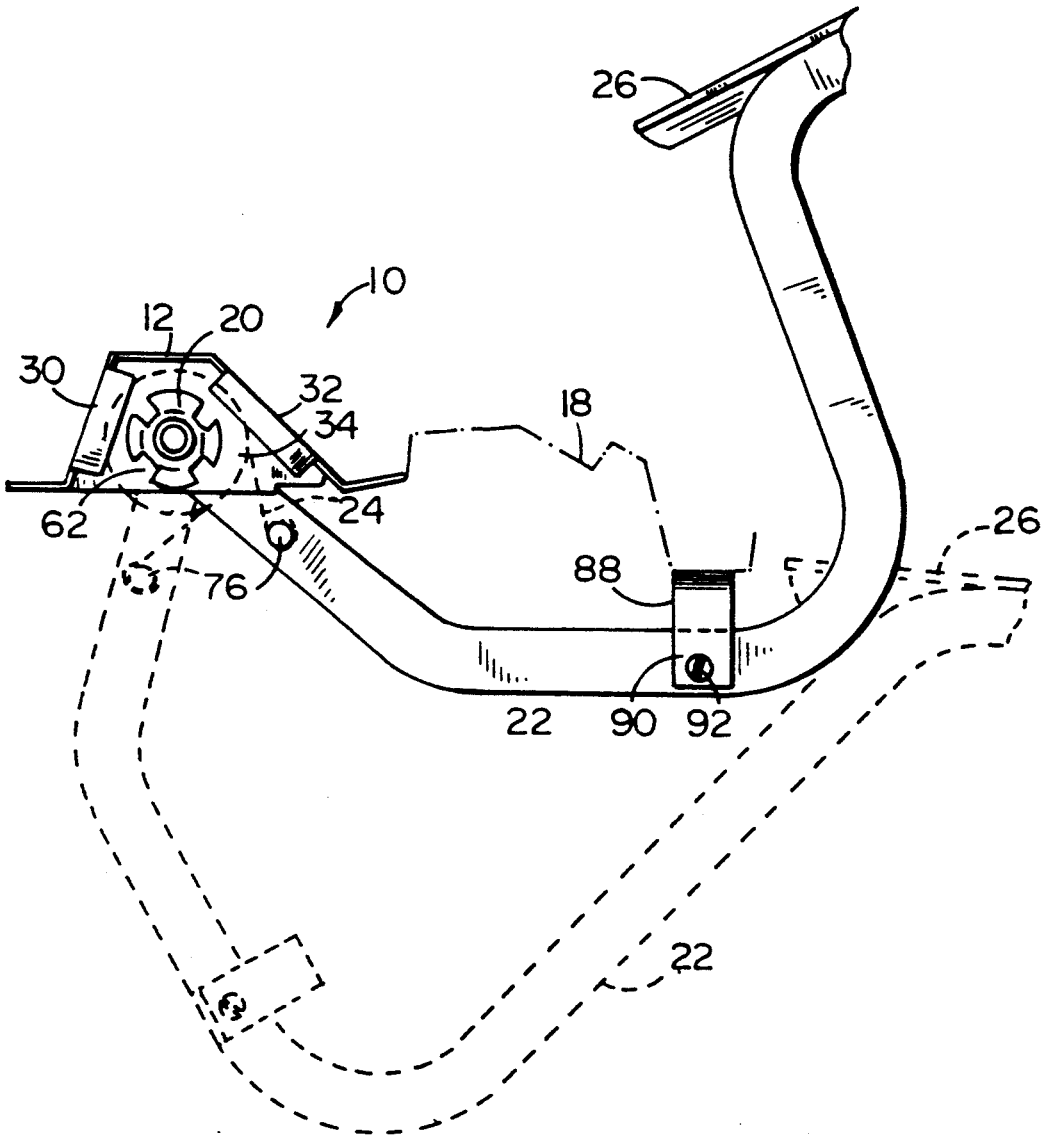
FIG. 9 is a side view of FIG. 1.

Slot 70 optimally extends inwardly from second end 78 of pivot pin 20 and provides a convenient means for receiving a tool to adjustably tension spiral lift spring 24. The adjustment tool (not shown) can be slid axially into the tubular inner open interior 86 of pivot pin 20 from second end 78. The adjustment tool would include radially extending tabs or protrusions to engage slot 70. Lip 84 provides additional support and strength to the shape of pivot pin 20 near end 78 so that pivot pin 20 is not dimensionally distorted. The adjustment tool is contemplated to be a socket wrench or the like which can be ratcheted to rotate pivot pin 20 until a satisfactory amount of tension is given to spiral lift spring 24 to counterbalance the weight of deck lid panel 26 as it is released from a locked closed position. As deck lid panel 26 rotates upwardly (FIG. 9), the moment arm provided by the weight of panel 26 about the axis of rotation defined by pivot pin 20 is reduced, such that hinge 10 provides sufficient energy to hold panel 26 in a fully open position. Alternatively, near the closed position, panel 26 is nearly balanced by spiral lift spring 24 such that panel 26 can be either moved toward a closed or an open position without undue effort on behalf of an operator.

In the embodiment shown, hinge arm 22 (FIGS. 1 and 9) is a bent tubular member that is shaped into a three-dimensional part to avoid interferences presented by rear shelf 16 and other parts of vehicle 18. Hinge arm 22 includes a bumper 88 made of resilient rubber-like material, bumper 88 being positioned to engage a portion of vehicle 18 so as to avoid an abrupt and undesirable jar as panel 26 reaches a fully open position. Bumper 88 is affixed to hinge arm 22 by "Christmas tree" attachment buttons 92 which extend through flanges 90 on bumper 88 and engagingly into hinge arm 20.

Having described the preferred embodiment and the parts thereof, the uses and advantages of the present invention will become obvious to one skilled in the art. Hinge 20 is assembled by extending pivot pin 20 through hole 48 in side wall 34 and into hole 66 in hinge arm 22. Pivot pin 20 is then slid onto spiral lift spring 24 with inner end 72 of spring 24 engaging slot 70 in shaft 64 of pivot pin 20. Pivot pin 20 is then extended through hole 48 in side wall 36, the end 78 of pivot pin 20 extending laterally axially outwardly a distance sufficient to receive laterally biasing coil spring 80 and washer 82. The extreme end of pivot pin end 78 is then clinched or reamed so as to form lip 84 that retains the above noted parts in place. The outer end 74 of spiral lift spring 24 engages anchor pin 76 on hinge arm 22 so that spiral lift spring 24 biases hinge arm 22 counterclockwise (and biases pivot pin 20 in clockwise direction within housing 12). Pivot pin 20 is prevented from clockwise movement due to engagement of abutting surface 59 on pawls 54 of pivot pin 20 against stop 60 on catch 62 of housing 12.

As a vehicle proceeds along the assembly line, hinge 20 is attached to vehicle 18 by attachment tabs 44 and 46, and to panel 26 by hinge arm 22. When it is time for adjustment of the tension in spiral lift spring 24, an operator inserts a tool (not shown) into the open interior 86 of slotted end 78 of pivot pin 20. The tool engages slot 70 and, as the tool rotates pivot pin 20 counterclockwise, ramped portion 56 ramps pawls 54 up and over successive of catches 62. This causes an axial force that temporarily causes pivot pin 20 to move laterally axially against the biasing force of laterally biasing coil spring 80 to an intermediate extended position. As pawl 54 moves past successive of catches 62, coil spring 80 causes pivot pin 20 to snap axially back into a home position wherein pawls 54 and catches 62 engage, thus automatically holding the now increased tension in spiral lift spring 24. Thus, spiral lift spring 24 is increasingly tensioned until it provides a counterbalancing force sufficient to support the weight of panel 26 in a near closed position.

If the spiral lift spring 24 is over-tensioned, pivot pin 20 can be forced axially against the force of lateral bias coil spring 80 to a release position so that pawls 54 and catches 62 do not engage, and therefore pivot pin 20 can be rotated clockwise to release the tension in spiral lift spring 24. Thus, it is seen that the tension can be readily adjusted by a single operator in a safe and speedy fashion with significant convenience.

Once properly adjusted, hinge 20 provides a counterbalanced "floating" feel to panel 26 near the unlocked but near closed position of panel 26. Thus, panel 26 can be readily opened or closed therefrom with minimal effort by an operator. Also, as panel 26 is rotated toward an open position, the weight of panel 26 experiences a reduced moment arm about the pivoting axis provided by hinge 20, and thus hinge 20 readily holds panel 26 in an open position.

In the foregoing description, it will be readily appreciated by those skilled in the art that modifications may be made to the invention without departing from the concepts disclosed herein. Such modifications are to be considered as included in the following claims as interpreted by the Doctrine of Equivalents, unless these claims by their language expressly state otherwise.

The embodiments of the invention in which an exclusive property or privilege is claimed are defined as follows:

1. A hinge for holding a panel, comprising:

a housing having two spaced sides with a pair of aligned openings therein;

a pivot pin shaped to mateably fit within said pair of aligned openings, said pivot pin including first and second ends and a shaft;

a hinge arm including a first portion adapted to pivotally mount on said pivot pin shaft and a second portion adapted to securely attach to said panel;

lift spring means for biasing said hinge arm rotationally toward an open position about said pivot pin; and adjustment means for adjusting the tension of said lift spring means, said adjust means including a ratchet means for manually adjusting and holding a desired tension in said lift spring means, said pivot pin being axially moveable between an engaged position wherein said ratchet means is engaged and a release position wherein said ratchet is disengaged so that the tension of said lift spring means can be adjusted.

2. The apparatus as set forth in claim 1 wherein said ratchet means includes a pawl and catch which cooperate in a ratchet-like fashion.

3. The apparatus as set forth in claim 2 wherein said first end of said pivot pin includes a flange with one of said pawl or catch located thereon.

4. A hinge for holding a panel, comprising:

a housing having two spaced sides with a pair of aligned openings therein;

a pivot pin shaped to mateably fit within said pair of aligned openings, said pivot pin including first and second ends and a shaft;

a hinge arm including a first portion adapted to pivotally mount on said pivot pin shaft and a second portion adapted to securely attach to said panel;

lift spring means for biasing said hinge arm rotationally toward an open position about said pivot pin; and adjustment means for adjusting the tension of said lift spring means, said adjustment means including a ratchet means for manually adjusting and holding a desired tension in said lift spring means, and further including release means for releasing said ratchet means permitting the operator to reduce the tension in said lift spring means, said ratchet means including a pawl and catch which cooperate in a ratchet-like fashion, said first end of said pivot pin including a flange with one of said pawl or catch located thereon, and the one of said sides of said housing adjacent said flange including the other of said pawl or catch.

5. The apparatus as set forth in claim 4 wherein said pivot pin is rotatable to actuate said adjustment means.

6. A hinge for holding a panel, comprising:

a housing having two spaced sides with a pair of aligned openings therein;

a pivot pin shaped to mateably fit within said pair of aligned openings, said pivot pin including first and second ends and a shaft;

a hinge arm including a first portion adapted to pivotally mount on said pivot pin shaft and a second portion adapted to securely attached to said panel;

lift spring means for biasing said hinge arm rotationally toward an open position about said pivot pin; and adjustment means for adjusting the tension of said lift spring means, said adjustment means including a ratchet means for manually adjusting and holding a desired tension in said lift spring means, and further including release means for releasing said ratchet means permitting the operator to reduce the tension in said lift spring means;

said pivot pin being axially movable between a home position and an extended position, and including lateral bias means for biasing said pivot pin toward said home position, said pivot pin axially ratcheting between said home position and said extended position as said

7. The apparatus as set forth in claim 6 wherein said release means includes means for moving said pivot pin axially against said lateral bias means to said extended position so that said pawl and catch are released whereby the tension in said lift spring means can be adjusted.

8. A hinge for holding a panel, comprising:

a housing having two spaced sides with a pair of aligned openings therein;

a pivot pin shaped to mateably fit within said pair of aligned openings, said pivot pin including first and second ends and a shaft;

a hinge arm including a first portion adapted to pivotally mount on said pivot pin shaft and a second portion adapted to securely attach to said panel;

lift spring means for biasing said hinge arm rotationally toward an open position about said pivot pin; and adjustment means for adjusting the tension of said lift spring means, said adjustment means including a ratchet means for manually adjusting and holding a desired tension in said lift spring means, and further including release means for releasing said ratchet means permitting the operator to reduce the tension in said lift spring means;

said pivot pin including a slot in said shaft, and said lift spring means including a spiral spring having an inner end adapted to engage said slot and an outer end adapted to engage said hinge arm.

9. The apparatus as set forth in claim 8 wherein said slot extends to one of said pivot pin ends, and said one end is adapted to receive a tool for rotating said pivot pin to thereby adjust the tension of said lift spring means.

10. The apparatus as set forth in claim 9 wherein said pivot pin is axially laterally movable between a home position and an extended position, said first end of said pivot pin and one of said sides of said housing including a pawl and catch arrangement which engages when said pivot pin is in said home position but releases when said pivot pin is in said extended position, and including bias means for biasing said pivot pin toward said home position.

11. The apparatus as set forth in claim 10 wherein said pawl and catch arrangement includes a ramped surface on said pawl that causes said pawl to slip past successive of said catches as said adjustment means is actuated to increase the tension on said lift spring means, thus forming said ratchet mechanism.

12. The apparatus as set forth in claim 1 wherein said pivot pin is rotatable to actuate said adjustment means.

13. A hinge for holding a panel, comprising:

a housing having two spaced sides with a pair of aligned openings therein;

a pivot pin shaped to mateably fit within said pair of aligned openings, said pivot pin including first and second ends and a shaft;

a hinge arm including a first portion adapted to pivotally mount on said pivot pin shaft and a second portion adapted to securely attach to said panel;

lift spring means for biasing said hinge arm rotationally toward an open position about said pivot pin; and adjustment means for adjusting the tension of said lift spring means, said adjustment means including a ratchet means for manually adjusting and holding a desired tension in said lift spring means, and further including release means for releasing said ratchet means permitting the operator to reduce the tension in said lift spring means;

said first end of said pivot pin including a flange with a pawl thereon, said housing including a catch positioned to mateably engage said pawl, said pivot pin being laterally moveable between a home position wherein said pawl and catch engage and a laterally extended position wherein said catch and pawl do not engage, and said ratchet mechanism ratcheting said pivot pin between said home and extended positions ad said adjustment means is actuated.

14. The apparatus as set forth in claim 13 wherein said pivot pin includes a shoulder for spacing said hinge arm axially on said pivot pin away from one of said sides of said housing.

15. The apparatus as set forth in claim 14 including a bias means for biasing said pivot pin toward said home position, said pivot pin including a retension means for holding said bias means on said pivot pin.

16. A hinge assembly comprising:

a housing having two spaced walls with apertures therein, one of said walls having a catch thereon;

a pivot pin defining an axis of rotation and shaped to mateably rotatably fit within said apertures in said spaced walls, said pivot pin including a first end with a flange having a pawl thereon, said pivot pin positionable in a home position so that said pawl is positioned to engage said catch to prevent rotation of said pivot pin in said housing in a first direction but allowing said pivot pin to rotate in a second direction about said axis, said flange positioned to limit the position of said pivot pin relative to said housing in a first axial direction, but allowing said pivot pin to move in a second axial direction wherein said pawl does not engage said catch;

lateral bias means for biasing said pivot pin in said first axial direction;

a hinge arm pivotally mounted to said pivot pin; and lift spring means for biasing said hinge arm rotationally in said first direction about said axis.

17. The apparatus as set forth in claim 16 wherein said pivot pin includes a slot in said shaft, and wherein said lift spring means includes a spiral spring having an inner end adapted to engage said slot and an outer end adapted to engage said hinge arm.

18. The apparatus as set forth in claim 16 wherein said lateral bias means includes a coil spring positioned over the end of said pivot pin, said pivot pin including a retension means for holding said bias means on said pivot pin.

19. A hinge for holding a panel, comprising:

a housing including aides, one of said sides including a stop;

a pivot pin rotatably mounted on said housing sides, said pivot pin including a radially extending tab for engaging said stop;

a hinge arm pivotally mounted on said pivot pin, said hinge arm including means for attaching said arm to a panel;

coil lift spring means mounted on said pivot pin and engaging said hinge arm and said pivot pin for biasing said hinge arm rotationally toward an open position about said pivot pin; and adjustment means for manually adjusting the tension of said coil lift spring means, said adjustment means including said stop and said tab, said pivot pin being axially movable to a release position so that said tab is released from said stop, whereby the tension of said coil lift spring means is adjustable.

20. The apparatus as set forth in claim 19 wherein said adjustment means includes inclined surfaces for automatically axially shifting said pivot pin when increasing the tension on said coil lift spring means.

21. A hinge for holding a panel, comprising:

a housing;

a pivot pin rotatably mounted on said housing;

a hinge arm pivotally mounted on said pivot pin, said hinge arm including means for attaching said arm to a panel;

coil lift spring means mounted on said pivot pin and engaging said hinge arm for biasing said hinge arm rotationally toward an open position about said pivot pin;

adjustment means for manually adjusting the tension of said coil lift spring means; and release means for manually reducing the tension on said coil lift spring means;

said pivot pin being axially movable between a home position and an extended position, and including lateral bias means for biasing said pivot pin toward said home position, said pivot pin axially ratcheting between said home position and said extended position as said adjustment means is actuated to increase the tension of said coil lift spring means.

22. The apparatus as set forth in claim 19 wherein said pivot pin includes a shaft and a slot in said shaft, and wherein said coil lift spring means includes a spiral spring having an inner end adapted to engage said slot and an outer end adapted to engage said hinge arm.

23. The apparatus as set forth in claim 19 wherein said adjustment means includes a pawl and catch arrangement that ratchets during adjustment, said tab and said stop forming said pawl and catch arrangement.

* * * * *